United States Patent [19]

Scott

[11] 4,425,724

[45] Jan. 17, 1984

[54] PAPER HOLDING AND DISPLAYING DEVICE

[76] Inventor: Harvey Scott, P.O. Box 1623, Clemson, S.C. 29631

[21] Appl. No.: 323,905

[22] Filed: Nov. 23, 1981

[51] Int. Cl.[3] ..... B09F 3/16

[52] U.S. Cl. ..... 40/11 A; 40/23 R; 40/124; 40/124.4; 24/67.9; 24/67.11

[58] Field of Search ..... 40/124, 610, 124.4, 40/11 A, 11 R, 611, 2 R, 124.1, 23 R, 13, 10 R, 23 A, 539, 616, 615; 24/67.11, 67.9, 67.3, DIG. 8, DIG. 9, 252 R, 255 R, 259 R, 259 FS, 30.5 P, 30.5 S, 255 BS, 255 SL, 256

[56] References Cited

U.S. PATENT DOCUMENTS

| | | | |
|---|---|---|---|
| 863,265 | 8/1907 | Crouse | 40/11 A |
| 903,724 | 11/1908 | Johnson | 24/67.11 |
| 1,067,320 | 7/1913 | Cunin | 24/67.11 |
| 1,241,564 | 10/1917 | Schreiber | 40/11 A |
| 1,587,335 | 6/1926 | Kline | 24/67.11 |
| 1,652,939 | 12/1927 | Holmes | 24/261 R |
| 1,840,604 | 1/1932 | Randall | 24/67.11 |
| 1,997,894 | 4/1935 | Woodley | 24/67.11 |
| 2,008,019 | 7/1935 | Horlick, Jr. | 40/23 R |
| 2,722,434 | 11/1955 | Wolfe | 40/124.1 |
| 3,165,283 | 1/1965 | Borisof | 248/467 |
| 3,309,052 | 3/1967 | Borisof | 248/205 A |
| 3,438,143 | 4/1969 | Wolfersberger, Jr. | 40/23 R |
| 3,889,409 | 6/1975 | Thomas | 40/11 A |
| 4,035,940 | 7/1977 | Mickey et al. | 40/611 |
| 4,055,874 | 11/1977 | Brown | 24/67.9 |
| 4,243,338 | 1/1981 | Williams | 40/124.1 |

*Primary Examiner*—Gene Mancene
*Assistant Examiner*—James R. Hakomaki
*Attorney, Agent, or Firm*—Howson and Howson

[57] ABSTRACT

Wire paper clips are firmly secured in slits formed in a layer of sheet material to provide a paper holding and displaying device on which notes can be attached by sliding them under the portions of the clips on the front face of the sheet. Portions of the clips on the rear face of the sheet are held frictionally between elements which can be parallel ribs in the case of an extruded sheet, corrugations in the case of a corrugated laminate, or small heat-sealed areas in the case of two back-to-back sheets heat sealed together. In another version, the slitted sheet is a relese liner on a section of foam adhesive tape, and the portion of the clip on the rear face of the release liner is held between the release liner and the tape. The release liner is preferably coated on only one side, and the device is prepared by first removing the release liner, installing the clip in a slit in the release liner, and then reattaching the release liner to the foam tape with the uncoated side toward the foam tape so that the release liner becomes permanently secured to the foam tape.

A free-standing bulletin board can be made from two sheets of extruded polymeric material, one sheet serving as a base and having upstanding slotted ears, and the other sheet serving as an upright and having feet engaging the slots and held thereby.

7 Claims, 18 Drawing Figures

PAPER HOLDING AND DISPLAYING DEVICE

BRIEF SUMMARY OF THE INVENTION

This invention relates to paper holding and displaying devices using wire clip paper attachment means.

Bulletin boards presently available make use of various types of attachment devices. Perhaps the most common type of attachment device is the pushpin or the thumbtack. Pushpins and thumbtacks have the disadvantage that, after a period of use, they tend to destroy portions of the bulletin board requiring replacement of the board. They are also dangerous to children because of their sharp points. Thumbtacks in particular are dangerous because when they are dropped they tend to land with their points up. This frequency results in injuries. Thumbtacks and pushpins have the further disadvantage that they are frequently dropped accidentally, and are easily lost.

Magnets constitute another class of bulletin board fastening devices. In general, magnets are safer than thumbtacks and pushpins, but they require ferromagnetic bulletin board materials, and, like thumbtacks and pushpins, are easily dropped and lost.

A third class of attachment devices includes the various forms of clips which can be used to attach papers to bulletin boards. Examples of clips are given in the following U.S. Pat. Nos.: Holmes 1,652,939; Johnson 903,724; Woodley 1,997,894; Kline 1,587,335; Cunin 1,067,320; Crouse 863,265 and Schreiber 1,241,564. In general, these clips are complex, and their arrangement on a bulletin board is usually quite limited. In some cases, they require special manipulations in their operation.

The principal objects of this invention are to provide a paper holding and displaying device which uses readily available wire paper clips, which provides for secure attachment of paper, and which requires the use of only one hand to attach and detach papers. A further object of the invention is to provide a paper holding and displaying device of the clip type to which the clips can be easily attached on which the clips nevertheless remain securely in place unless intentionally removed. A still further object of the invention is to provide a paper holding and displaying device which can be easily but securely attached to a variety of surfaces.

There are four basic versions of the paper holding and displaying device in accordance with this invention.

The first version is used as a bulletin board and comprises a substantially rigid sheet which is preferably a polymeric extrusion comprising two spaced, parallel sheets connected together by parallel, integrally formed ribs, or alternatively a laminate comprising one substantially flat sheet having a corrugated sheet secured to one of its faces. In this first version of the device, a slit is provided in a direction perpendicular to the ribs or corrugations. A part of a wire clip, which is in the form of a J-shaped section is located between corrugations or between ribs so that the corrugations or ribs hold the clip firmly against lateral movement. Another J-shaped section of the clip lies against the exposed face of the sheet for securing papers thereto. In the preferred form of this version of the invention, the return bend of the clip, by which the two J-shaped sections are interconnected, extends behind the face of the sheet, and upwardly from the slit so that it also is firmly held between ribs or corrugations as the case may be. When this is done, the clip is very firmly held in place, and cannot be removed as a result of normal manipulations involved in the attachment and detachment of notes and the like.

The second basic version of the device is also used primarily as a bulletin board and comprises a relatively soft, heat-sealable polymeric sheet having a slit or an array of slits. This sheet is arranged back-to-back with another similar sheet or with a rigid sheet having a heat-sealable coating. Each slit has at least two heat-sealed areas associated with it by which the two sheets are secured together. These heat-sealed areas are preferably located so that the J-shaped section of the clip which is located between the sheets is received between them and held by them against lateral movement. A further refinement on this version of the invention is the provision of an additional heat-sealed area located a short distance above the slit and being engaged by the return bend of the clip in such a way as to limit the upward movement of the clip.

The third basic version of the device comprises a foam pad having adhesive strips on one side. These strips are spaced from each other so that a clip can be slipped over the pad with one of its loops between the adhesive strips. The pad with the clip attached to it can be adhesively secured to a wall or other surface and sheets of paper can be readily attached to and removed from the device.

The fourth basic version of the device comprises a sheet of foam tape or a foam pad having a first adhesive layer on one side for attachment to a wall or other surface, a second adhesive layer on the opposite side, and a layer of sheet material covering the second adhesive layer. The layer of sheet material is slitted, and a paper clip extends through the slit with one of its J-shaped sections on the outside face of the release layer and the other J-shaped section held between the release layer and the second adhesive layer.

The rigid version of the device is especially useful as a free-standing bulletin board, which can be used in association with a telephone to attach notes of telephone numbers and various reminders. In accordance with the invention, this free-standing bulletin board can be formed from the corrugated or extruded material described above. Unless the corrugated or extruded material is scored along lines perpendicular to the ribs or corrugations, the ribs or corrugations serve as stiffeners. The material therefore exhibits a substantial inherent resistance to bending along lines perpendicular to the ribs or corrugations. The stiffness imparted to the materials by the ribs, corrugations or other suitable means makes possible the use of sheets of these materials as base and back elements of a free-standing bulletin board without the need for special reinforcements.

The free-standing bulletin board comprises a horizontal base section comprising a substantially flat portion of sheet material with a pair of upstanding ears integrally formed thereon and hinged thereto along bend lines which are parallel to the ribs or corrugations. These ears have vertical slots. The board also has a vertical section comprising a substantially flat portion of sheet material with feet formed thereon. These feet extend laterally outward in the plane of the vertical section and through the slots in the ears of the base section. The vertical section is preferably arranged with its ribs or corrugations extending vertically. Provisions are made for locking the ears of the base in fixed relationship to the feet of the vertical section to form a free-standing bulletin board which is most conveniently used by placing a telephone on its base.

The version of the invention comprising heat-sealed sheets lends itself readily to use on walls and other vertical surfaces. It can be cut to any desired size, and can even be used with only one clip as a hanger for single sheets of paper.

The versions of the invention comprising a foam tape or pad can be adhesively attached to any of a wide variety of walls and other surfaces without the need for auxiliary fastening devices. They can even be attached adhesively to rough surfaces such as painted cinder-block walls.

Various additional objects, uses and advantages of the invention will be apparent from the following detailed description when read in conjunction with the drawings.

DETAILED DESCRIPTION

Figure 1:
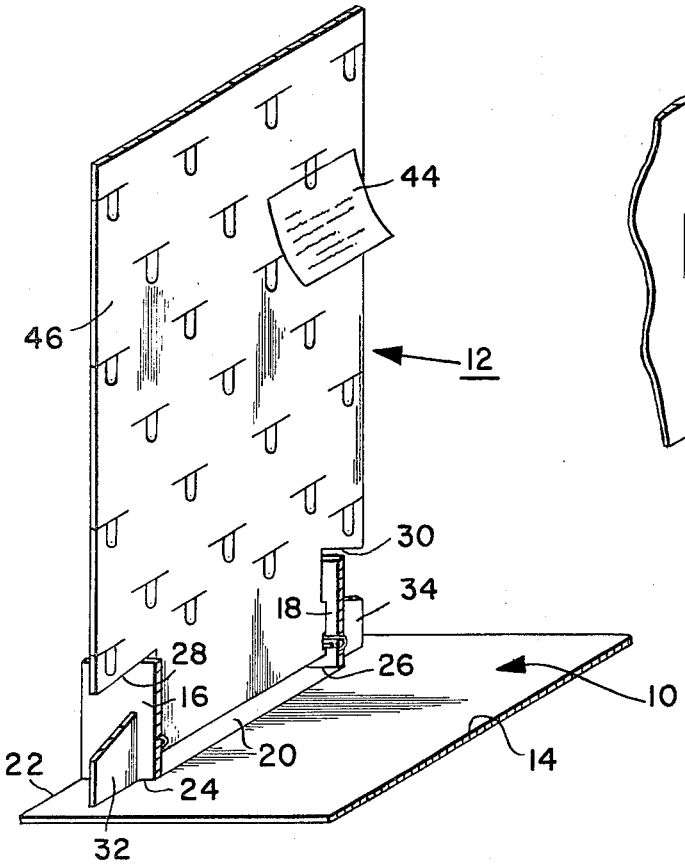
FIG. 1 is an oblique perspective view of a freestanding bulletin board in accordance with the invention.

FIG. 1 shows a free-standing bulletin board comprising a base section 10 and a vertical section 12. Both sections are cut from a sheet material which has a substantial resistance to bending along lines parallel to at least one axis. A preferred material having the desired characteristics is an extruded polymeric sheet material comprising two parallel sheets connected by parallel, integrally formed internal ribs. These sheets are available in polypropylene from Primex Plastics Corp., 1 Raritan Road, Oakland, N.J. 07436 under the trademark "PRIME COR-X".

Figure 2:
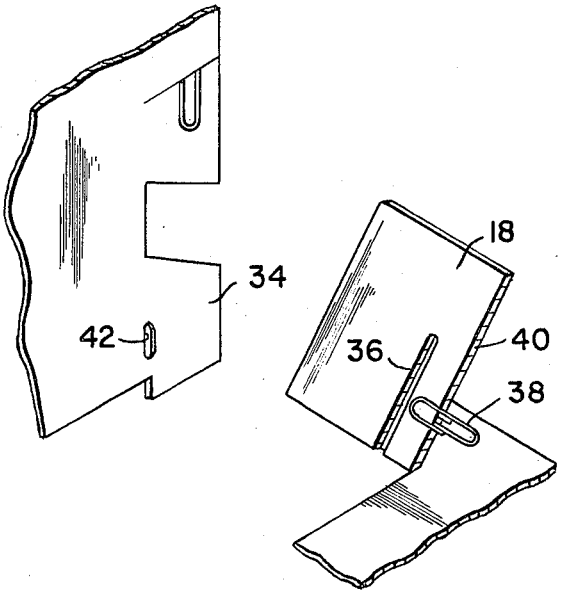
FIG. 2 is an exploded fragmentary view illustrating the manner in which the two principal elements of the freestanding bulletin board are secured together.

Base section 10 is generally rectangular in shape, with the internal ribs extending perpendicular to its front edge 14. Thus the base 10 is substantially resistant to bending along lines parallel to front edge 14. Ears 16 and 18 are formed by cutting a T-shaped slit at the rear edge 22 of base section 10, and bending along lines 24 and 26 to provide ears 16 and 18 on either side of a cut-out section 20. Vertical section 12 has its internal ribs extending vertically, and is therefore resistant to bending along horizontal lines. Near its lower edges, notches are provided at 28 and 30, and laterally extending feet 32 and 34 are formed in the plane of section 12 by the portions thereof below the notches. Foot 32 extends through a slot in ear 16, and foot 34 similarly extends through a slot in ear 18. Referring to FIG. 2, the manner in which assembly is effected will be apparent. Foot 34 is inserted through slot 36 in ear 18. An ordinary paper clip 38, the smaller J-shaped section of which extends between a pair of ribs in edge 40 of ear 18 is pushed through a hole 42 located at the root of foot projection 34. With clip 38 in place in hole 42, ear 18 is locked onto foot 34. Foot 32 is locked to ear 16 in a similar manner, and the base and vertical sections are securely held together.

The structure of FIG. 1 can be made not only from extruded polymeric sheets, but also from various other sheet materials, including corrugated boards comprising one flat sheet with a corrugated sheet adhered to one of the faces of the flat sheet.

An array of clips for the attachment of notes such as note 44 is provided on face 46 of vertical section 12. The manner in which clips are secured to vertical section 12 is illustrated in FIGS. 3 and 4.

Figure 3:
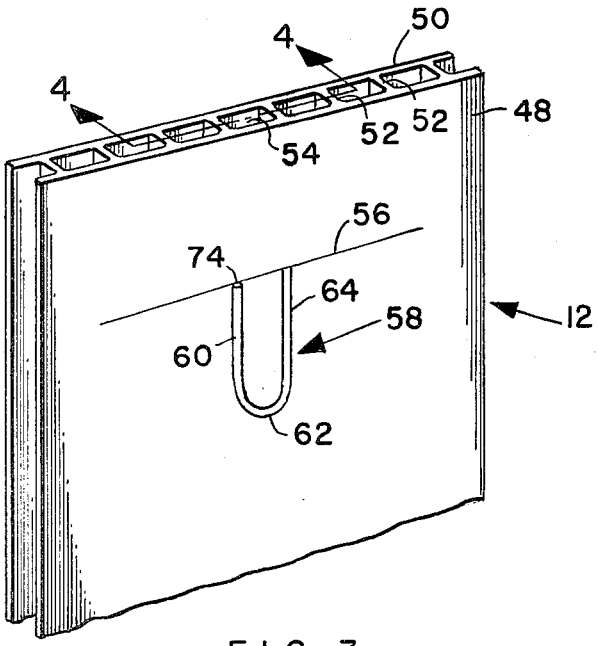
FIG. 3 is a fragmentary perspective view of a portion of the vertical member of the board of FIG. 1, showing the details of the extruded sheets and ribs, and also illustrating the exposed portion of an attachment clip secured to the board.
Figure 4:
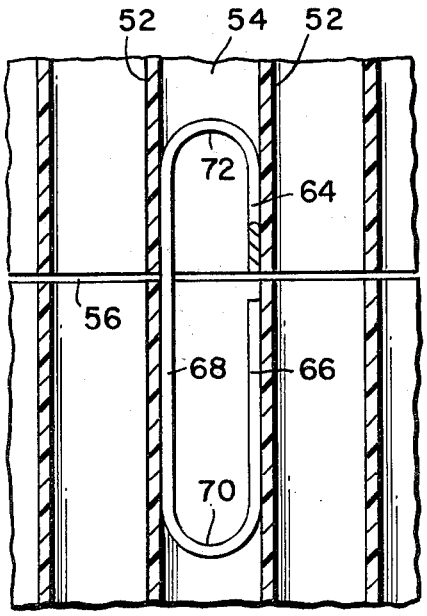
FIG. 4 is a vertical section taken on the plane 4—4 indicated in FIG. 3, showing the manner in which a clip is held in place within a channel formed between a pair of adjacent ribs of the extrusion.

The material of vertical section 12 of the bulletin board, which is shown in detail in FIG. 3 comprises a front sheet 48, a rear sheet 50, and a series of parallel, vertically extending internal ribs 52. These ribs are uniformly spaced, and form vertically extending internal channels such as channel 54. A slit 56 is formed in the board. This slit is perpendicular to ribs 52, and preferably extends through both of sheets 48 and 50. Preferably it cuts through approximately six ribs in order to provide the necessary flexibility for insertion of a clip 58. Clip 58 is an ordinary wire paper clip comprising a single length of wire bent to form two J-shaped sections. One J-shaped section is narrower than, and normally located inside the other. The short leg of each J-shaped section is located adjacent the long leg of the other J-shaped section, and the long legs of the J-shaped sections are continuous with each other and connected to each other by a return bend.

Referring to FIG. 3, the wider of the two J-shaped sections of clip 58 is shown against the face of sheet 48. This J-shaped section comprises parallel, elongated legs. A short leg 60 is connected through a return bend 62 to a longer leg 64, the latter extending through slit 56 into channel 54, as shown in FIG. 4.

The narrower of the two J-shaped sections of clip 58 also comprises two parallel, elongated legs 66 and 68, leg 66 being the shorter one. Legs 66 and 68 are connected to each other through a return bend 70. The width of the J-shaped section comprising legs 66 and 68 is such that this section fits snugly between adjacent ribs 52 of channel 54. These ribs therefore hold the clip against movement in the direction parallel to the slit. They also provide a degree of resistance against movement of the clip along the channel, and thus serve to reduce the likelihood of inadvertent movement of the clip during use of the bulletin board. The two J-shaped sections are continuous with each other and interconnected by a 180° return bend 72, which is located above slit 56, and also held snugly between ribs 52 of channel 54. The width of return bend 72 is between the widths of the J-shaped sections. Although return bend 72 is slightly wider than the narrower of the two J-shaped sections of the clip, it nevertheless fits between ribs 52 by reason of distortion of the rib material, and also by reason of a slight twisting of the clip which takes place when bend 72 is pushed upwardly into the part of channel 54 above slit 56.

Clip 58 is inserted in slit 56 by first inserting the smaller of the two J-shaped sections through the slit, and urging it downwardly until the upper end of return bend 72 engages or nearly engages the edge of sheet 48 just below the slit opening. Return bend 72 is then pushed upwardly into the portion of channel 54 above the slit until the upper end 74 of leg 60 (FIG. 3) reaches the approximate location of the slit. The clip thus installed is firmly held against both vertical and horizontal movements. Sheets of paper can be inserted underneath the clip, between the clip and the face of the bulletin board as shown in FIG. 1, and insertion and removal of the sheets of paper can be accomplished with one hand, as it is not necessary to use a separate fastener such as a pushpin, thumbtack or magnet.

Figure 5:
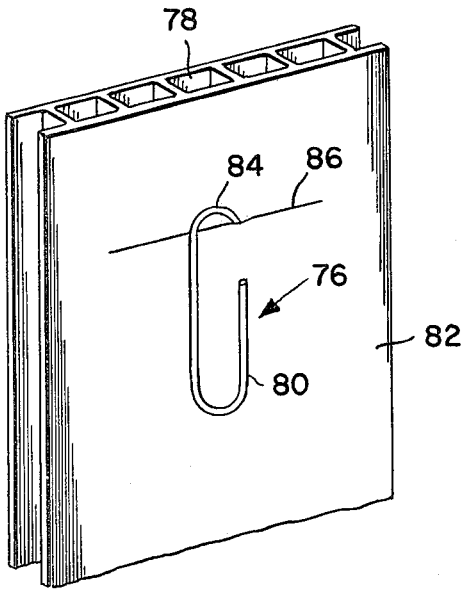
FIG. 5 is a fragmentary perspective view of an extruded bulletin board element illustrating an alternative manner in which a clip can be attached to the board.

FIG. 5 shows an alternative manner for installing a clip in an extruded polymeric sheet. Essentially, what is involved is the installation of the clip by inserting one of the two J-shaped sections through the slit into one of the internal channels until the return bend which interconnects the two J-shaped sections comes into close proximity with the slit. The step of moving the return bend upwardly into the internal channel is eliminated. Thus, in FIG. 5, one of the two J-shaped sections of clip 76 is located within channel 78, and the other J-shaped section 80 lies against face 82 of the sheet. The return bend 84, by which the two J-shaped sections are interconnected is closely adjacent slit 86. Because bend 84 does not enter channel 78, less flexibility is needed in the sheet, and accordingly slit 86 can be shorter. For example, in the case of FIG. 5, slit 86 cuts through only four vertical ribs.

Yieldability between the upper and lower edges of a slit varies according to the length of the slit. Short slits such as slit 86 in FIG. 5 are less yielding than long slits such as slit 56 in FIG. 3. Being less yielding, a short slit makes it harder to install a clip. On the other hand, the short slit keeps the clip in place even if it is not moved upwardly into the channel above the slit as is the case in FIG. 3. In FIG. 5, the limited yieldability of the short slit keeps the upper edge of the slit from moving either forward or rearward of the top of the clip. Thus, the shortness of the slit in FIG. 5 contributes to the securing of the clip.

In the case of a long slit as in FIG. 3, the upper and lower slit edges are more freely movable with respect to each other. However, moving the upper end of the clip into the channel above the slit reduces the relative movability of the upper and lower edges of the slit. This positions the downwardly facing upper edge of slit 56 in a position such that it can be engaged by end 74 of clip leg 60. This places a limit on upward movement of the clip. Thus, even if the frictional constraints on the clip relax because of plastic creep, the clip will not move upwardly beyond the position in which it is shown in FIG. 3. Moving the upper end of the clip into the channel above the slit also rigidifies and strengthens a heavily slit board, compensating for the weakening of the board resulting from the slitting operation.

Figure 6:
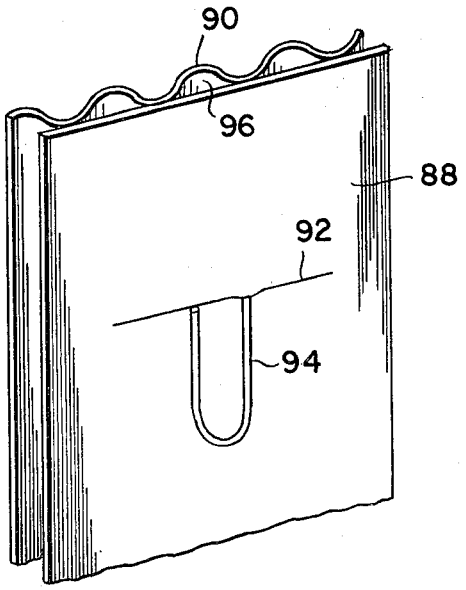
FIG. 6 is a fragmentary perspective view of an alternative rigid bulletin board material comprising a flat sheet with a corrugated sheet attached to it.

In the version of the invention shown in FIG. 6, the sheet material comprises a flat sheet 88, and a corrugated sheet 90, which is adhesively secured to the rear of sheet 88. A slit is provided at 92, and a clip 94 is installed in the same manner as illustrated in FIGS. 3 and 4. The smaller of the two J-shaped sections of the clip is located within channel 96 formed between the corrugated sheet 90 and flat sheet 88. The width of the corrugations is such as to hold the J-shaped section of the clip and the interconnecting return bend firmly. This corrugated version of the sheet can be used to make a free-standing bulletin board similar to that shown in FIGS. 1 and 2. It can be made from a wide variety of materials, including various polymeric sheet materials, and heavy paper as well.

Figure 7:
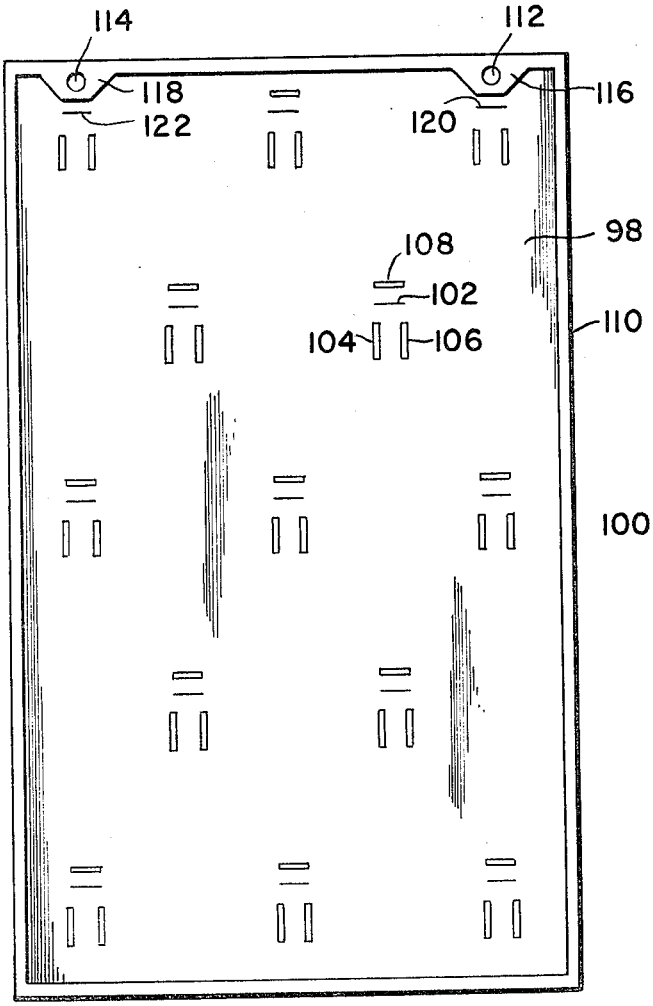
FIG. 7 is a front elevation of the version of a paper holding and displaying device comprising two heat-sealable sheets in back-to-back relationship.
Figure 8:
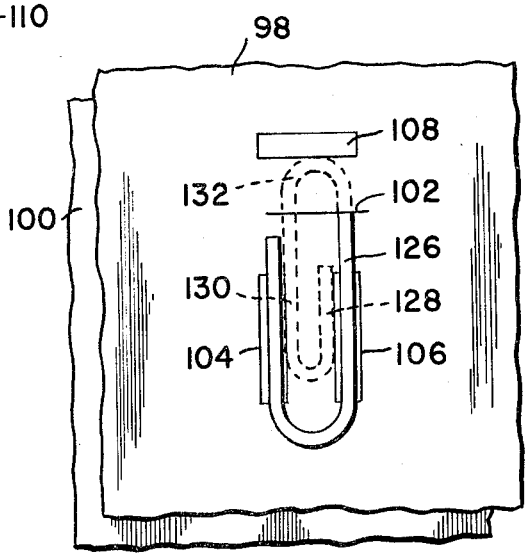
FIG. 8 is a fragmentary view illustrating the manner in which a clip is secured to the device of FIG. 7.

The second basic version of the invention, shown in FIGS. 7 and 8 comprises a flexible heat-sealable sheet 98 of polyethylene, plasticized polyvinyl chloride, or similar material, and a backing sheet 100, which can be a flexible, heat-sealable material similar to that of sheet 98, or alternatively a card of paper or the like having a heat-sealable coating. As shown in FIG. 7, sheet 98 is provided with an array of slits, one such slit being indicated at 102. The sheets are heat-sealed together to form heat-sealed areas 104, 106 and 108 adjacent slit 102. Similar heat-sealed areas are provided in association with the remaining slits. In addition, a heat-sealed border is provided at 110. Holes 112 and 114 are provided along the top of the sheet assembly for hanging on hooks, and enlarged border sections 116 and 118 are provided around the respective holes. Heat-sealed area 116 is located just above a slit 120, and serves the same function as heat-sealed area 108 associated with slit 102. Heat-sealed area 118 is likewise located just above slit 122.

Referring to FIG. 8, clip 126 has its larger J-shaped section located against the face of sheet 98. It extends through slit 102 so that its smaller J-shaped section, consisting of short leg 128 and long leg 130 is located between heat-sealed areas 104 and 106. The heat-sealed areas are desirably spaced from each other by a distance such that the smaller J-shaped section of the clip fits snugly between them. Thus, the heat-sealed areas serve the same function as the ribs of FIG. 4 in that they prevent lateral movement of the clip in the plane of the sheet, and at the same time resist vertical movement, and thereby resist inadvertent downward displacement of the clip during use. The return bend 132 of the clip, by which the two J-shaped sections are interconnected is located between the sheets and above slit 102. It is in engagement with heat-sealed area 108, which serves to prevent inadvertent upward movement of the clip during use.

Clips are installed in the paper holding and displaying device of FIG. 7 in substantially the same manner as described with reference to the bulletin board of FIGS. 3 and 4. That is, the smaller J-shaped section is inserted through the slit until the interconnecting return bend reaches the slit. The interconnecting return bend is then moved through the slit, and upwardly between the slits until it engages heat-sealed area 108.

The device of FIGS. 7 and 8 is especially well suited for hanging on walls or other structures, although it can be adapted for use in a structure similar to that of FIG. 1 if sheet 100 is made from a board of suitable stiffness. By printing sheet 100 prior to coating it with a heat-sealable material, and using a transparent material for sheet 98, the board of FIGS. 7 and 8 can be decorated in any desired color or pattern.

Figure 9:
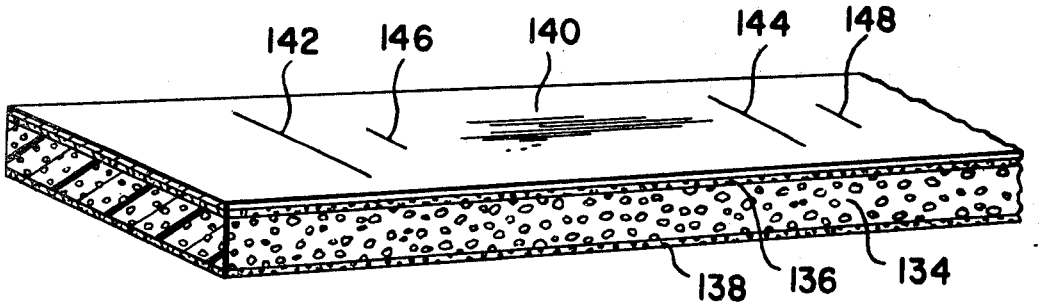
FIG. 9 is a fragmentary perspective view of a length of foam tape having a cover sheet prepared with long slits providing for separation of the length of tape into individual units and short slits for accommodating metal clips.
Figure 10:
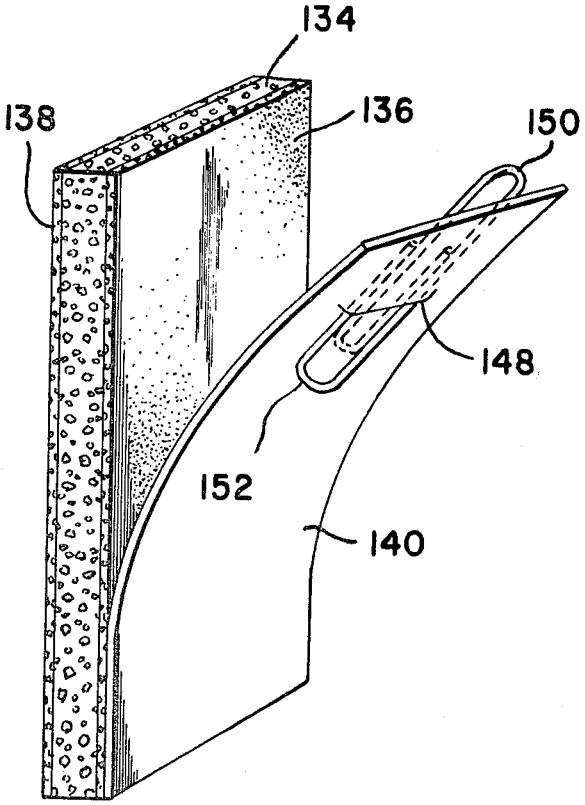
FIG. 10 is a perspective view of a foam tape unit with its cover sheet partially peeled away for installation of a clip.
Figure 11:
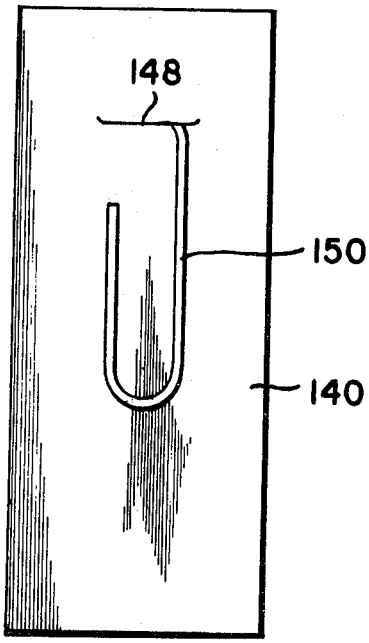
FIG. 11 is a front elevation of a foam tape unit with a clip installed, ready to receive and hold a sheet of paper.

The version of the invention shown in FIGS. 9, 10 and 11, comprises a layer 134 of foam tape having adhesive layers 136 and 138 on its opposite faces. The foam tape can be a cross-linked, closed-cell polyethylene foam, a polyvinyl chloride foam, or any one of a wide variety of other synthetic foams. The adhesive is typically a synthetic rubber-based adhesive, which can be provided either in layers 136 and 138 as shown, or throughout the entire layer of foam. Layer 140 is a release layer comprising a silicone-treated densified kraft paper.

The material of FIG. 9 may be provided in the form of a tape of any desired length. Suitable tapes are available from Fasson Industrial Division, Avery International, 250 Chester Street, Painesville, Ohio 44077 under the trademark FASMOUNT. The tape is preferably one inch wide, and approximately 1/32 inch thick. The release layer is about 0.0036 inch thick. The release layer 140 is die-cut at 142 and 144, and similarly along the length of the tape at uniform intervals so that the tape can be easily divided into units approximately $2\frac{3}{8}$ inch long. These die-cuts 142 and 144 need not extend the full width of the tape, but should extend completely through the release layer.

To one side of die-cut 142 there is provided a slit 146. This slit is spaced from die-cut 142 by a distance of about 7/16 inch. Slit 146 is about 5/16 inch in length, and is centered on the tape so that its ends are spaced from the edges of the release layer. A similar slit is provided at 148.

In use, a unit such as that shown in FIG. 10 is removed from the tape by cutting along cut 144. The release layer 140 is peeled back as shown, and a clip 150 is inserted through slit 148 from the rear so that its larger J-shaped section 152 extends through the slit and lies against the exposed face of release layer 140 while the smaller J-shaped section of clip 150 is located behind the release layer. The release layer is then returned to engagement with adhesive layer 136, and the smaller J-shaped section of the clip is then held securely between the release layer and the foam sheet, with the clip positioned as shown in FIG. 11.

The unit of FIG. 11 can then be secured to a wall or any other desired surface by means of adhesive layer 138 (FIG. 10).

The unit of FIG. 11 can be used to attach sheets of paper and the like to walls and other surfaces. It is capable of holding papers securely, and exhibits very little wear after repeated use. It has the advantage that the foam tape securely attaches to a wide variety of surfaces, and even to very rough surfaces such as painted cinderblock walls.

Although the release layer can be peeled away from the foam layer easily, it nevertheless holds the clip very securely because peeling of the release layer must begin at one of its edges or at one of its corners, whereas the clip and the slit in which the clip is held are well spaced from the edges and corners of the release layer. Consequently, relatively strong forces can be exerted on the clip in any direction without resulting in the peeling away of the release layer from the foam.

The securing of the clip is accomplished in part by virtue of the fact that the smaller of its J-shaped sections is held between portions of the release layer which are adhesively secured to the foam, and also partly by virtue of the action of the adhesive layer 136 on the clip itself.

While it is convenient to use the release layer for securing the clip, it is also possible to use other sheet materials such as slitted polyethylene sheets in place of the release layer in conjunction with adhesive-faced foam tapes or sheets to produce units which perform substantially in the same manner as the device shown in FIG. 11.

While the version of the invention shown in FIGS. 9–11 may be supplied as a tape or in the form of individual pads, it can also be supplied in the form of a large sheet. Individual fasteners such as those shown in FIGS. 10 and 11 can be removed from the sheet. Typically, the large sheet would comprise a large, uncut release liner with individual die-cut fasteners peelable away from the uncut release liner. As an alternative, the large sheet can be used intact as a bulletin board with multiple clips secured to it.

While FIG. 10 shows the installation of a clip by temporarily peeling cover layer 140 away from the foam sheet, it is possible to produce a fastener similar to the one shown in FIG. 11 in which the cover layer is permanently laminated to the foam. In the formation of this version of the fastener, the portion of the face of the foam which comes into contact with the metal clip is non-adhesive. This can be accomplished by a special application of adhesive, or even more conveniently by the application of a non-adhesive substance over the adhesive layer at the desired locations. One way to accomplish this is to apply ink, or varnish, or a polyester film by any one of a variety of printing processes such as jet printing, vapor printing, silkscreening, or various types of offset or pad transfer printing. Desirably, the non-adhesive layer is an elongated layer, the borders of which generally follow the outline of the portion of the metal clip between the cover sheet and the foam. The cover sheet is permanently bonded to the foam, and the clip can be inserted without peeling the cover sheet. In this version of the invention, the clip is held securely in place in much the same manner as the clip is held in the version shown in FIGS. 7 and 8. With the non-adhesive area properly positioned, the clip can even be moved upwardly after it is inserted in the slit, and positioned with respect to the slit in a manner similar to what is shown in FIG. 8.

Figure 12:
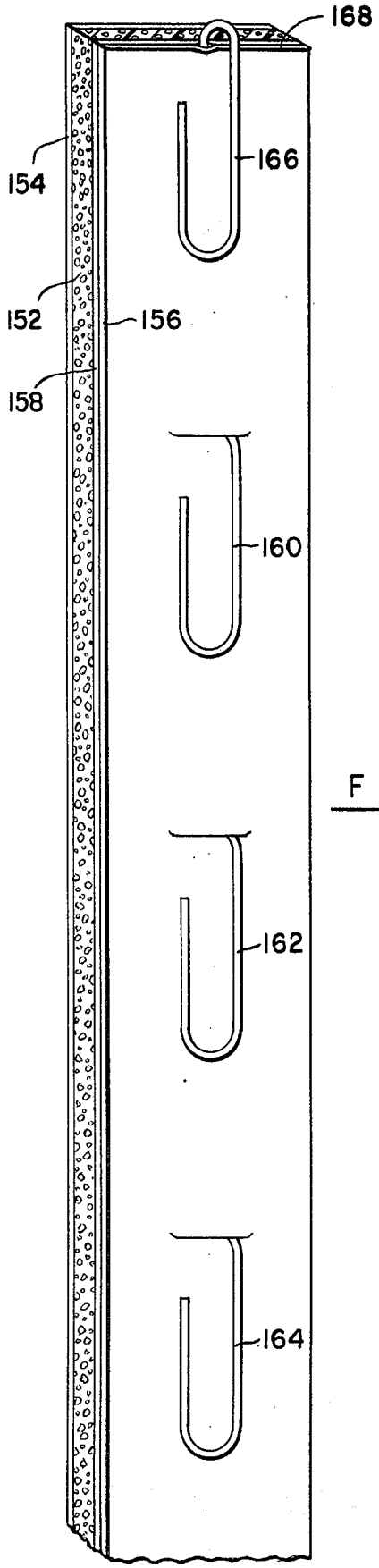
FIG. 12 is a fragmentary perspective view of an alternative foam tape paper holding and displaying device.

A modified version of the fastener of FIGS. 9, 10 and 11 is shown in FIG. 12. It comprises an elongated foam tape 152 having an adhesive layer 154 on one side for attaching it to a wall or other surface, and a paper layer 156 adhered to the face of foam tape 152 by adhesive layer 158. Paper layer 156 is a coated paper layer which can be peeled away from the foam tape. It is coated on both sides so that it can be peeled away from the tape, and so that sheets of note paper can be readily slipped under the clip mounted on the device.

Clips 160, 162 and 164 are secured to paper layer 158 in the same manner as illustrated in FIG. 10. An additional clip 166, rater than extending through a slit, extends over the upper edge 168 of paper layer 156. Thus, in this device, a vertical series of clips can be provided on a strip of any desired length, with the uppermost clip located at the upper edge of the paper layer, and with the remaining clips extending through slits located at intervals along the vertical length of the strip.

An alternative to the device shown in FIG. 12 is a horizontally extending strip having vertically extending clips at spaced intervals along its horizontal length. These clips can extend through appropriately positioned slits, or can extend over the upper edge of the front paper layer.

While it is possible to eliminate slits altogether in the horizontally extending strip, and also in single fastening units of the kind shown in FIG. 11 by positioning the clips so that they extend over the upper edge of the paper layer, the use of slits is preferred where the device is intended for long term use.

Figure 13:
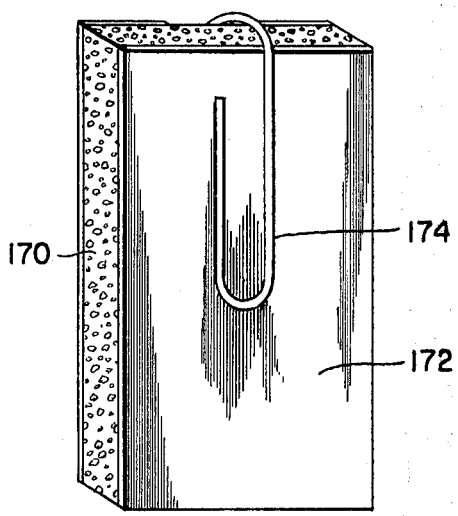
FIG. 13 is a perspective view showing the front side of another form of foam tape device.
Figure 14:
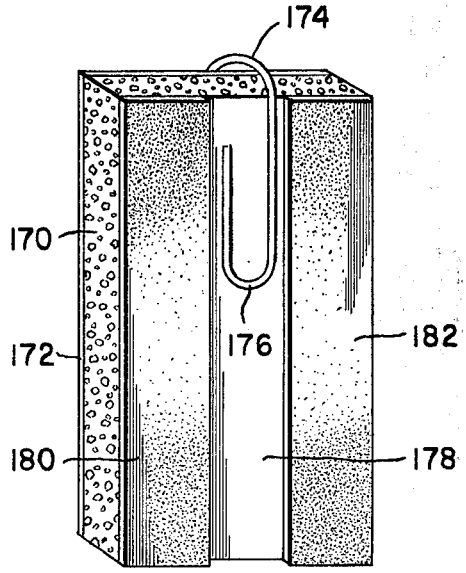
FIG. 14 is a perspective view showing the rear side of the device of FIG. 13.

The paper holding and displaying device shown in FIGS. 13 and 14 does not require a peelable paper layer for securing the clips to a foam pad or tape. This is because the clip, as illustrated, extends over the entire foam layer of the device.

The device comprises a foam layer 170, with a paper layer 172 on its front face. This paper layer is coated at least on its outwardly facing surface to provide a smooth face allowing note paper to be slipped underneath clip 174. The clip, as shown in FIG. 14 extends over the upper edge of foam layer 170 and its smaller loop 176 bears against the rear face 178 of the foam layer between two vertically extending adhesive strips 180 and 182. While parallel adhesive strips are shown, the arrangement of adhesive can take many alternative forms. However, it is desirable to provide a surface without adhesive near the upper end of the rear face of the clip so that clip loop 176 can be slid over the pad.

An alternative version of the device in FIGS. 13 and 14 which is not illustrated comprises a similarly constructed foam pad with a slit extending through the foam pad so that the clip can extend through the slit with its loops on opposite sides of the pad. Either version of the device is easily affixed to a wall or similar surface simply by removing a protective layer (not shown) to expose the adhesive on the rear face of the device, attaching the clip to the device, and then pressing the device with the clip attached against a wall or similar surface. The unslitted device, as shown in FIGS. 13 and 14 has some tendency to collect dust, and when the device is in constant use, the collection of dust may have a tendency to destroy its adhesion to the surface to which it is attached. However, the device has the merit of being of very inexpensive, and it can be easily removed and replaced with a new device, if necessary.

With either version of the device in FIGS. 13 and 14, the clip compresses the foam layer creating depressions on both of the front and rear faces. The depression on the front face is shallower than the depression on the rear face because of the stiffness of the paper layer 172. The depression on the rear face provides a protective pocket for clip loop 176 and prevents it from rubbing against the wall or other surface. Because the protective pocket prevents the clip loop from rubbing against the wall, it is not necessary to provide a foam layer between the clip and the wall as in FIG. 12.

While paper layer 172 may be desirable in some cases because of its stiffness, and because of its coating, it is possible to eliminate this paper layer because a sheet of paper can be slid between a clip and the bare face of a foam layer.

Still another version of the paper holding and displaying device is illustrated in FIGS. 15, 16, 17 and 18.

Figure 15:
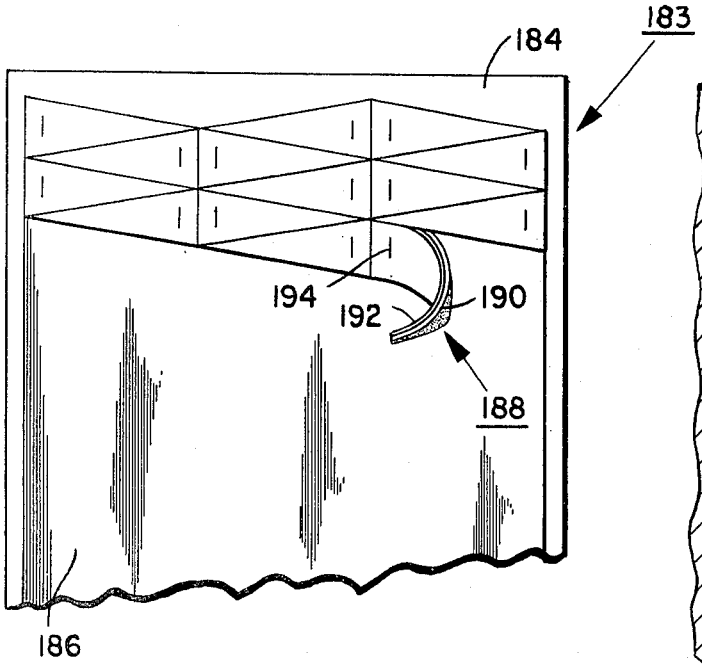
FIG. 15 is an elevational view of a sheet carrying multiple triangular-shaped paper holding and displaying device which can be individually removed from the sheet for use.

FIG. 15 shows a die-cut sheet 183 of foam material. This sheet has paper layers secured to both of its sides by adhesive layers. The paper layer 184 on the front side of the sheet is uncoated on its outer surface, but is coated on the surface which faces the foam.

As shown in FIG. 15, the front paper layer and the foam pads are die-cut to provide a large number of triangular units which can be peeled away from the back sheet 186. One such triangular unit is shown at 188. It comprises a foam layer 190 and a paper layer 192. The paper layer has a clip-receiving slit 194.

Figure 16:
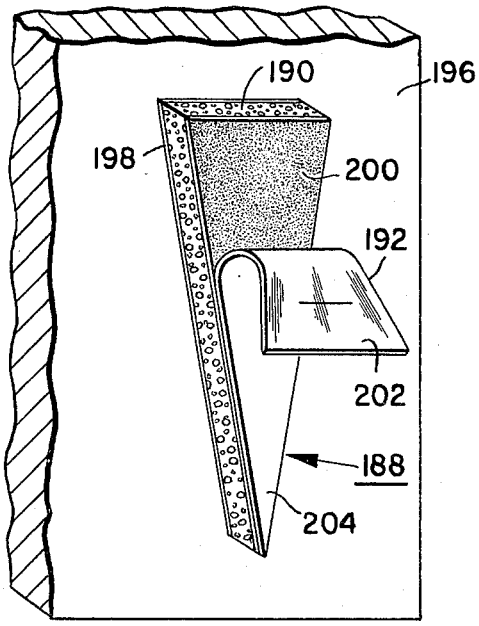
FIG. 16 is a perspective view showing first and second steps in the preparation of one of the devices in FIG. 15 for use.
Figure 17:
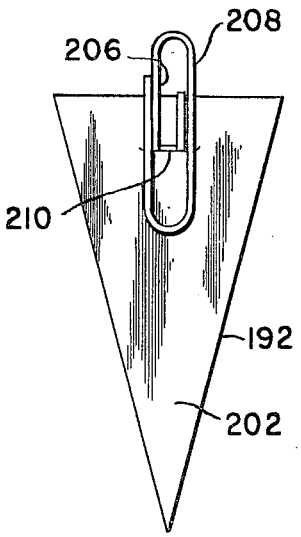
FIG. 17 is an elevational view showing the third step in the preparation of the device of FIG. 15.
Figure 18:
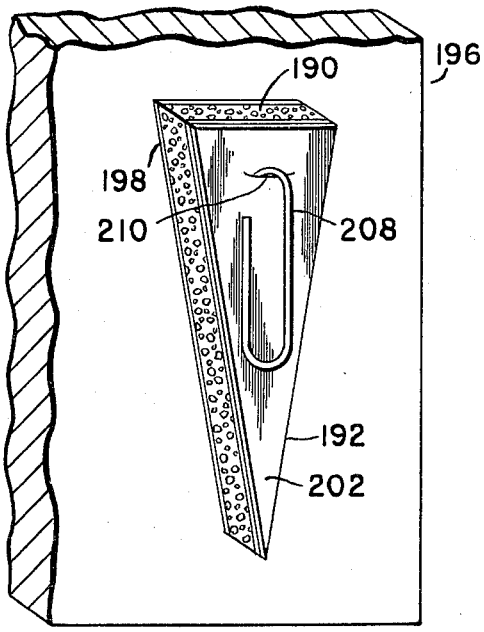
FIG. 18 is a perspective view showing the final step in the preparation of the device of FIG. 15.

FIGS. 16, 17 and 18 illustrate further steps in the preparation of device 188 for use. As shown in FIG. 16, device 188 after it is peeled away from sheet 186, is secured to a surface 196, such as a wall, by adhesive layer 198 on the rear side of foam layer 190. Paper layer 192 is peeled away, and completely removed from the foam layer, so that adhesive layer 200 is exposed on the side of foam layer 190 facing away from surface 196. It should be noted that side 202 of paper layer 192 has a silicone or polyethylene release coating, while side 204 has no such coating. The smaller loop 206 of a clip 208 is inserted through slit 210 from coated side 202 of triangular layer 192 as shown in FIG. 17. The clip is pushed down, and layer 192 is then reattached to the triangular foam pad as shown in FIG. 18. When the triangular paper layer is reattached, it is reversed from its original position so that the uncoated side 204 is in contact with adhesive layer 200 (FIG. 16). This causes paper layer 192 to be permanently attached to the foam pad.

The reversal of the paper layer which is coated on one side only provides for a very secure attachment of the clip to the pad. This, in turn, permits a comparatively small size of pad to be used without sacrificing strength and reliability. As a result, a large number of individual paper holding and displaying units can be provided in a single die-cut sheet of a given size. The triangular shape of the units also contributes to the large number of triangular units which can be provided on a single sheet. Of course, a reversible paper layer such as described with reference to FIGS. 15–18 can be used to advantage in the embodiments of FIGS. 9 and 12, where the paper holding and displaying devices are rectangular in shape. Various other shapes besides rectangular and triangular can, of course, be used.

It should be noted in FIG. 18 that the upper end of the clip is on the outside face 202 of paper layer 192 rather than between the paper layer and the foam pad. This is advantageous because it provides for a larger area of adhesion between the paper layer and the foam pad, and also because it eliminates the air pocket which would otherwise exist between the paper sheet and the pad above the slit. This provides for a more secure attachment of the paper layer to the pad in the critical area above the slit. This same advantage can be achieved in the device of FIG. 10, but ordinarily the paper layer will have to be completely removed from the foam pad in order to permit the clip to be inserted from the front of the paper layer.

The several versions of the paper holding and displaying device described above eliminate the danger of using bulletin board fasteners with sharp points, and also eliminate the need for removable fasteners which can be easily lost. The clips can be, and preferably are, conventional wire paper clips. They are easily installed on the several versions of the device. Consequently, the devices can be supplied as kits, with clip installation performed by the ultimate user. While the clips are easily installed, the structure of the various versions of the device holds them firmly in place and prevents them from being inadvertently removed.

In the versions of the invention in which foam pads are used together with paper layers, the foam pads and the paper layers are desirably but not necessarily coextensive. In some instances, it may be desirable to use a relatively small pad and a larger paper layer. Various release coatings in addition to those specifically mentioned herein can be used in those versions of the invention comprising foam pads with attached paper layers. Desirably, the coating, when used on the outside face of the device when it is condition ready for use is a rubber-like surface which provides for good frictional holding of note paper between the clip and the face of the device, and which at the same time permits sheets of note paper to be readily slipped underneath the clip without effort. Silicone and polyethylene coatings have been found to be ideal for this purpose, but various other substances can be used.

While foam pads are desirable for conformity with various surfaces, and especially rough surfaces such as painted cinderblock walls and the like, it is possible to take advantage of various aspects of the invention by eliminating the foam pads altogether and using adhesive-coated paper tapes in place of the rectangular paper layer of FIG. 10 or the triangular paper layer of FIG. 17. These adhesive-coated paper tapes are slitted, paper clips are installed in the slits, and the tapes can then be adhered directly to any of a variety of comparatively smooth surfaces.

Other tape materials such as polyethylene, polypropylene, polyvinyl chloride, and various polyesters can be used. These materials, as well as paper tapes can be supplied in sheet form on a release liner, or in tape form either with or without release liners.

The bulletin boards in accordance with the invention can be made in any desired size and shape and with any desired number of and pattern of clips.

I claim:

1. In combination with a rigid, vertical surface, a paper holding and displaying device for attachment to said surface comprising:

a paper clip having first and second sections each comprising two legs connected together by a U-shaped loop, the legs and loop of each of the sections lying substantially in a common plane, and at least one leg of one of the first and second sections being connected to at least one leg of the other of said first and second sections at a location remote from both of said loops by a third section, one leg of the first section being located adjacent to one leg of the second section, and the other leg of the first section being located adjacent to the other leg of the second section, and said third section having a spring characteristic whereby said first and second sections are urged toward each other when spread apart;

a layer of flexible sheet material having a front and rear face, with a slit spaced from its edges, said clip having substantially its entire first section lying against said front face, having substantially its entire second section lying against said rear face and having its third section extending through said slit;

an additional flexible layer of material;

adhesive means securing one face of the additional flexible layer to the rear face of the layer of sheet material with the second section of the clip located between said layers; and an adhesive coating on the opposite face of the additional flexible layer securing the device to said rigid, vertical surface.

2. The combination according to claim 1 in which said additional flexible layer of material is a layer of foam material.

3. The combination according to claim 1 in which said additional flexible layer of material is a layer of foam material, and in which the front face of said layer of flexible sheet material is coated with a release coating and its rear face is permanently adhered by said adhesive means to said one face of said additional flexible layer of material.

4. A paper holding and displaying device comprising a layer of foam sheet material having an adhesive coating on both of its faces and first and second layers of unfoamed sheet material temporarily held on the respective faces by said adhesive coatings, the sides of said unfoamed sheet material facing toward said layer of foam sheet material having release coatings permitting them to be peeled away from the layer of foam sheet material, wherein the layer of foam sheet material and the first unfoamed layer are die-cut to provide a plurality of triangular elements which can be peeled away from the second unfoamed layer, wherein the portion of the first unfoamed layer on each triangular element is provided with a slit parallel to one of its edges and spaced from all of its edges, and in which the outer face of the first unfoamed layer is provided with a surface which, when brought into contact with the adhesive coating on said foam sheet which temporarily holds said first layer, causes said first layer to become permanently secured to said foam sheet layer.

5. A method of preparing a paper holding and displaying device comprising the steps of:

providing a layer of foam sheet material having an adhesive coating on both of its faces and first and second layers of unfoamed sheet material temporarily held on the respective faces by said adhesive coatings, wherein the sides of said unfoamed sheet material facing toward the layer of foam sheet material have release coatings permitting them to be peeled away from the layer of foam sheet material, and the outer face of the first unfoamed layer is provided with a surface which, when brought into contact with the adhesive coating on said foam sheet which temporarily holds said first layer, causes said first layer to become permanently secured to said foam sheet layer;

peeling said second layer away from said layer of foam sheet material and thereby exposing one of the adhesive coatings on said layer of foam sheet material;

adhesively securing said foam sheet to a surface by means of the exposed adhesive coating;

peeling said first unfoamed layer away from said layer to foam sheet material;

attaching a paper clip to the first unfoamed layer so that first and second sections of the clip lie against opposite faces of the first unfoamed layer; and adhesively securing said first unfoamed layer, with the clip attached, to said layer of foam sheet material, with the release coating facing away from said foam sheet.

6. A method of preparing a paper holding and displaying device comprising the steps of:

providing a layer of foam sheet material having an adhesive coating on both of its faces and first and second layers of unfoamed sheet material temporarily held on the respective faces by said adhesive coatings, wherein the sides of said unfoamed sheet material facing toward the layer of foam sheet material have release coatings permitting them to be peeled away from the layer of foam sheet material, the first unfoamed layer is provided with a slit spaced from all of its edges, and the outer face of the first unfoamed layer is provided with a surface which, when brought into contact with the adhesive coating on said foam sheet which temporarily holds said first layer, causes said first layer to become permanently secured to said foam sheet layer;

peeling said second layer away from said layer of foam sheet material and thereby exposing one of the adhesive coatings on said layer of foam sheet material;

adhesively securing said foam sheet to a surface by means of the exposed adhesive coating;

peeling said first unfoamed layer away from said layer of foam sheet material;

inserting a paper clip into the slit in said first unfoamed layer so that first and second sections of the clip lie against opposite faces of the first unfoamed layer; and adhesively securing said first unfoamed layer, with the clip inserted in its slit, to said layer of foam sheet material, with the release coating facing away from said foam sheet.

7. A paper holding and displaying device comprising:

a wire paper clip comprising a single length of wire bent to form two J-shaped sections, each section having a short leg and a long leg, one J-shaped section being narrower than, and normally located inside the other, the short leg of each J-shaped section being located adjacent the long leg of the other J-shaped section and the long legs of said J-shaped sections being continuous with each other and connected to each other by a return bend;

a layer of sheet material having a front and rear face and a slit extending from one face to the other, and the wire of said clip extending through said slit so that one J-shaped section lies against the front face of the sheet and the other J-shaped section lies against the rear face of the sheet;

means on the rear face of the layer for engaging both legs of said other J-shaped section and preventing movement thereof in directions parallel to the slit; and a layer of foam material having front and rear faces with adhesive layers on both faces, in which the layer of sheet material is adhesively secured to the front face of the foam layer and in which the J-shaped section of the clip which lies against the rear face of the sheet is secured between said sheet and said front face.

* * * * *